United States Patent [19]

Ackerman et al.

[11] Patent Number: 4,792,883

[45] Date of Patent: Dec. 20, 1988

[54] RUNNERS BATON BAT

[76] Inventors: Archie W. Ackerman, George Spector, 233 Broadway, RM 3815; George Spector, 233 Broadway, RM 3815, both of New York, N.Y. 10007

[21] Appl. No.: 75,649

[22] Filed: Jul. 20, 1987

[51] Int. Cl.[4] ..... F21L 7/00

[52] U.S. Cl. ..... 362/102; 362/103; 362/190

[58] Field of Search ..... 362/102, 103, 186, 190, 362/191

[56] References Cited

U.S. PATENT DOCUMENTS

| | | | |
|---|---|---|---|
| 1,155,377 | 10/1915 | Spalding | 362/103 |
| 1,287,250 | 12/1918 | Dailey | 362/190 |
| 1,416,153 | 5/1922 | Wright | 362/103 X |
| 2,908,901 | 10/1959 | Lewis | 362/102 X |
| 3,016,549 | 1/1962 | Finn | 362/102 X |
| 3,737,649 | 6/1973 | Nelson et al. | 362/102 |

FOREIGN PATENT DOCUMENTS

| | | | |
|---|---|---|---|
| 2106022 | 9/1972 | Fed. Rep. of Germany | 362/102 |

*Primary Examiner*—Tony M. Argenbright
*Assistant Examiner*—Eric R. Carlberg

[57] ABSTRACT

A baton for a runner is provided that can be held in the hand or worn on a belt. The baton consists of a lightweight segmented cylinder having interchangable compartments for holding various items needed by the runner.

1 Claim, 1 Drawing Sheet

RUNNERS BATON BAT

BACKGROUND OF THE INVENTION

The instant invention relates generally to night sticks and more specifically it relates to a baton for a runner.

Numerous night sticks have been provided in prior art that are adapted to combine flashlights with billy-clubs. For example, U.S. Pat. Nos. 2,257,227; 3,737,649 and 4,479,171 all are illustrative of such prior art. While these units may be suitable for the particular purpose to which they address, they would not be as suitable for the purposes of the present invention as heretofore described.

SUMMARY OF THE INVENTION

A primary object of the present invention is to poovide a baton for a runner that will overcome the shortcomings of the prior art devices.

Another object is to provide a baton for a runner that is held in the hand of the runner and consists of a lightweight segmented cylinder having interchangable compartments for holding various items needed by the runner.

An additional object is to provide a baton for a runner that contains a belt which can be worn around waist of the runner so that the baton can hang vertically therefrom.

A further object is to provide a baton for a runner that is simple and easy to use.

A still further object is to provide a baton for a runner that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
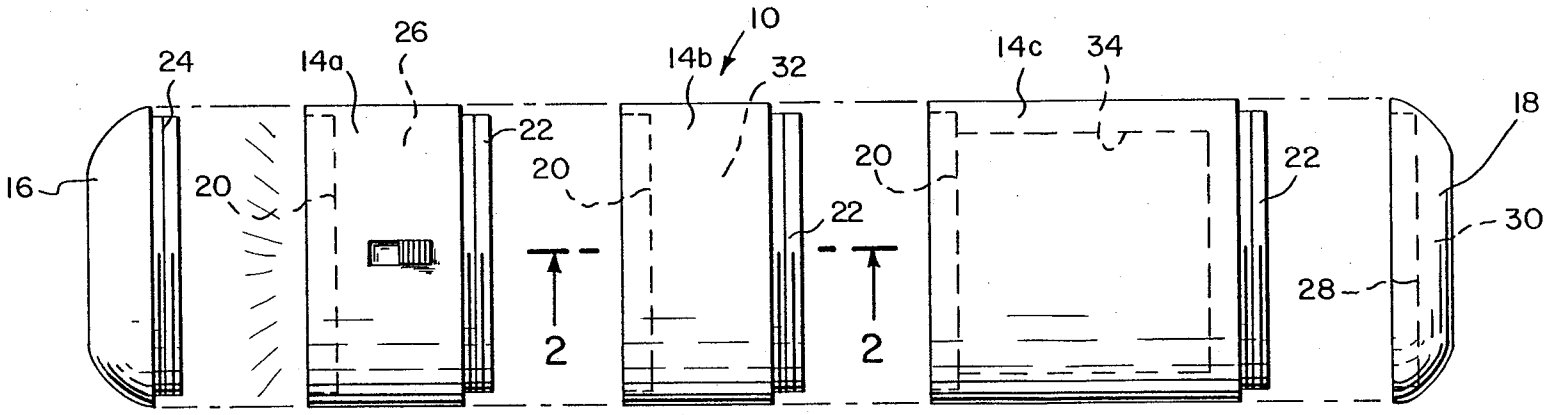
FIG. 1 is an exploded side view of the invention.
Figure 2:
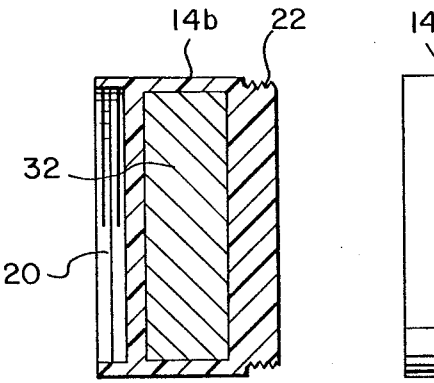
FIG. 2 is a cross sectional view taken along line 2—2 in FIG. 1 showing the leaded weight inside.

Turning now descriptively to the drawings, in which similar reference characters denote similar elements throughout the several views, FIGS. 1 through 5 illustrates a baton 10 for a runner 12 that consists of a plurality of interchangable lightweight cylindrical segments 14*a*, 14*b* and 14*c*, a first end cap 16 and a second end cap 18. Each of the segments 14*a*, 14*b* and 14*c* have internal threads 20 at one end and external threads 22 at other end. The internal threads 20 of one of the segments can engage with the external threads 22 of another of the segments.

The first end cap 16 has external threads 24 to engage with the internal threads 20 of one of the segments 14*a* at one side of the baton 10. The first end cap 16 is transparent and the segment 14*a* engaging the first end cap includes a built-in flashlight 26 therein. The segment 14*a* can also contain a radio receiver, mace dispenser, visibility light, audible alarm, CB channel nine transmitter, stopwatch or odometer.

The second end cap 18 has internal threads 28 to engage with the external threads 22 of another of the segments 14*c* at other side of the baton 10 so as to complete the baton thus allowing the runner 12 to hold the baton in their hand (not shown). The second end cap 18 includes a compartment 30 for holding a key (not shown) therein.

One of the segments 14*b* (see FIG. 2) includes a leaded weight 32 inside to increase upper body strength of the runner 12. One of the segments 14*c* (see FIG. 1) includes a compartment 34 for holding various items (not shown) therein. The items can include water, food, money, compacted clothing and ointment/medicine.

Figure 3:
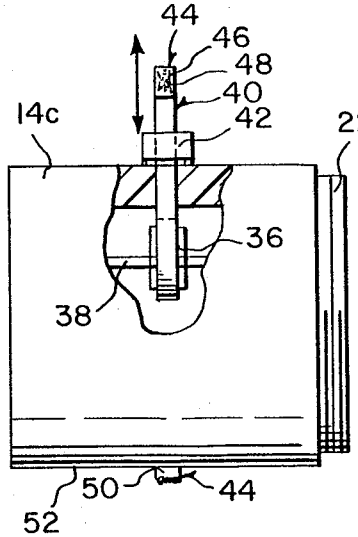
FIG. 3 is a side view with parts broken away of a modification showing a take up spool inside with a Velcro belt extending therefrom.
Figure 4:
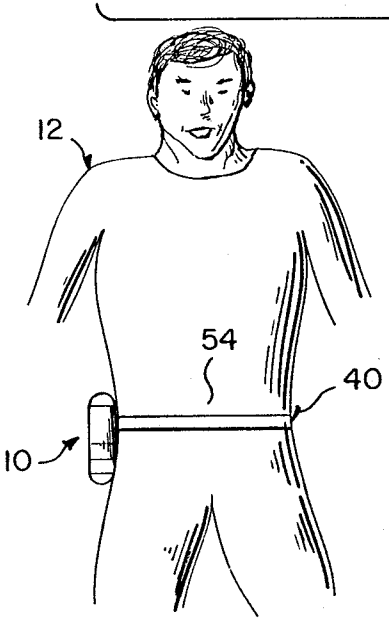
FIG. 4 is a front view of a person utilizing the modification by wearing the belt around the waist so that the invention can hang vertical therefrom.

As best seen in FIG. 3, one of the segments such as 14*c* can include a take up spool 36 which is spring biased and rotatably positioned within the segent 14*c* on shaft 38. A belt 40 is wrapped around the spool 36 and extends outwardly from the segment 14*c* through a door 42. A hook and loop pile fastener 44 is provided. One portion 46 of the hook and loop pile fastener 44 is attached to free end 48 of the belt 40 while other portion 50 of the hook and loop pile fastener 44 is attached to opposite side 52 of the segment 14*c*. The belt 40 can be wrapped around waist 54 of the runner 12 and attached to the opposite side 52 of the segment 14*c* allowing the baton 10 to hang vertically therefrom as shown in FIG. 4.

Figure 5:
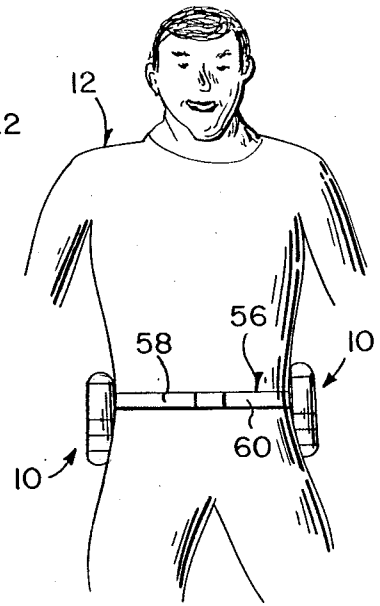
FIG. 5 is a front view of a person utilizing another modification by wearing a belt around the waist with a baton worn on each side of the person for equal weight distribution.

FIG. 5 shows another belt 56 that has attachable and detachable ends 58, 60. The belt 56 has two of the batons 10 spaced apart and affixed thereto. The belt 56 can be wrapped around waist 54 of the runner 12 allowing the batons 10 to hang vertically therefrom on each side of the runner 12 for equal weight distribution.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A baton for a runner comprising:

(a) a plurality of interchangeable lightweight cylindrical segments, each of said segments having internal threads at one end and external threads at the other end so that said internal threads of one of said segments can engage with said external threads of another of said segments;

(b) a first end cap having external threads to engage with said internal threads of one of said segments at one side of said baton;

(c) a second end cap having internal threads to engage with said external threads of another of said segments at the other side of said baton so as to complete said baton thus allowing said runner to hold said baton in a hand, wherein said first end cap is transparent and said segment engaging said first end cap includes a built-in flashlight thereon, wherein said second end cap includes a compartment for holding a key therein, wherein one of said segments includes a leaded weight inside to increase the upper body strength of said runner, wherein one of said segments includes a compartment for holding various items therein, wherein one of said segments includes:

(d) a take up spool spring biased and rotatably positioned within said segment;

(e) a belt wrapped around said spool and extending outwardly from said segment; and (f) a hook and loop pile fastener, one portion of said hook and loop pile fastener attached to the free end of said belt while the other portion of said hook and loop pike fastener is attached to the opposite side of said segment so that said belt can be wrapped around the waist of said runner, and attached to said opposite side of said segment allowing said baton to hang vertically therefrom.

* * * * *